US012643729B2

(12) United States Patent
Tattam et al.

(10) Patent No.: US 12,643,729 B2
(45) Date of Patent: Jun. 2, 2026

(54) LOW TEMPERATURE TRANSPORT AND STORAGE ASSEMBLY

(71) Applicant: Softbox Systems Limited, Long Crendon (GB)

(72) Inventors: Edwin Francis Tattam, Long Crendon (GB); Richard Darren Wood, Long Crendon (GB); Jack Walton, Long Crendon (GB); James Nathan Jarvis, Long Crendon (GB); Sean James Austerberry, Long Crendon (GB); Ross Malcolm Beech, Long Crendon (GB); Adam Delderfield, Long Crendon (GB)

(73) Assignee: Softbox Systems Limited, Long Crendon (GB)

( * ) Notice: Subject to any disclaimer, the term of this patent is extended or adjusted under 35 U.S.C. 154(b) by 0 days.

(21) Appl. No.: 18/023,110

(22) PCT Filed: Aug. 26, 2021

(86) PCT No.: PCT/EP2021/025323
§ 371 (c)(1),
(2) Date: Feb. 24, 2023

(87) PCT Pub. No.: WO2022/042886
PCT Pub. Date: Mar. 3, 2022

(65) Prior Publication Data

US 2024/0017908 A1 Jan. 18, 2024

(30) Foreign Application Priority Data

Aug. 26, 2020 (GB) ..... 2013399
Sep. 18, 2020 (GB) ..... 2014785
(Continued)

(51) Int. Cl.
*B65D 81/38* (2006.01)
*F25D 3/12* (2006.01)

(52) U.S. Cl.
CPC ..... *B65D 81/3825* (2013.01); *F25D 3/125* (2013.01); *F25D 2201/14* (2013.01)

(58) Field of Classification Search
CPC ... F25D 3/125; F25D 3/14; F25D 3/06; F25D 2201/14; B65D 81/3825; B65D 81/3827
See application file for complete search history.

(56) References Cited

U.S. PATENT DOCUMENTS 2,154,933 A 4/1939 Hadsell
2,807,402 A 9/1957 Nelbach
(Continued)

FOREIGN PATENT DOCUMENTS

CN 200960294 Y 10/2007
DE 10206109 C1 6/2003
(Continued)

OTHER PUBLICATIONS

International Search Report and Written Opinion dated Jan. 19, 2022, for International Application No. PCT/EP2021/025323, 13 pages.
(Continued)

*Primary Examiner* — Joseph F Trpisovsky
(74) *Attorney, Agent, or Firm* — FBT Gibbons LLP

(57) ABSTRACT

The present invention relates to the field of the transportation and the storage of thermally labile goods such as pharmaceuticals, and to a container system and apparatus (40) employing a total loss evaporation agent such as dry ice. In particular, but not necessarily restricted thereto, the present invention relates to a container system and apparatus
(Continued)

(40) for the transportation and the temperature controlled storage of ultra-low temperature, low volume, high value goods.

20 Claims, 12 Drawing Sheets

(30) Foreign Application Priority Data

| | | |
|---|---|---|
| Sep. 29, 2020 | (GB) | 2015409 |
| Oct. 13, 2020 | (GB) | 2016259 |
| Jan. 14, 2021 | (GB) | 2100491 |
| Jun. 10, 2021 | (GB) | 2108341 |

(56) References Cited

U.S. PATENT DOCUMENTS

| | | | | |
|---|---|---|---|---|
| 5,042,260 | A | 8/1991 | George, Sr. | |
| 6,244,458 | B1 | 6/2001 | Frysinger et al. | |
| 6,381,981 | B1 | 5/2002 | Yaddgo et al. | |
| 2005/0178142 | A1 | 8/2005 | Perry et al. | |
| 2006/0174648 | A1 | 8/2006 | Lantz | |
| 2008/0099492 | A1 | 5/2008 | Mayer | |
| 2013/0020309 | A1 | 1/2013 | Tattam et al. | |
| 2014/0144161 | A1 | 5/2014 | Pointer et al. | |
| 2017/0066582 | A1 | 3/2017 | Vogel et al. | |
| 2017/0305639 | A1 | 10/2017 | Kuhn et al. | |
| 2018/0335241 | A1 | 11/2018 | Li et al. | |
| 2019/0210790 | A1 | 7/2019 | Rizzo et al. | |
| 2020/0247602 | A1 | 8/2020 | Aminoff et al. | |
| 2021/0300660 | A1* | 9/2021 | Massenzo | B32B 5/02 |

FOREIGN PATENT DOCUMENTS

| | | | |
|---|---|---|---|
| DE | 202015002945 | U1 | 4/2016 |
| EP | 1074483 | A1 | 2/2001 |
| GB | 2566792 | A | 3/2019 |
| JP | S59-168688 | U | 11/1984 |
| JP | 2002-147914 | A | 5/2002 |
| WO | WO 2003/048007 | A1 | 6/2003 |
| WO | WO 2006/124149 | A2 | 11/2006 |
| WO | WO 2007/103267 | A2 | 9/2007 |
| WO | WO 2019/011478 | A1 | 1/2019 |
| WO | WO 2019/241720 | A1 | 12/2019 |

OTHER PUBLICATIONS

International Search Report and Written Opinion dated Jan. 24, 2022, for International Application No. PCT/EP2021/025324, 10 pages.

U.S. Appl. No. 18/023,113, entitled "A Transport Apparatus and Storage System," filed Feb. 24, 2023.

Utility Model Cancellation Proceedings dated Feb. 6, 2024, for German Utility Model No. 202021004304.7, 88 pages.

German Search Report dated Jun. 7, 2024, for Utility Model No. 202021004304.7, 5 pages.

Utility Model Cancellation Proceedings dated Jul. 10, 2024, for German Utility Model No. 202021004304.7, 120 pages.

Utility Model Cancellation Proceedings dated Feb. 4, 2025, for German Utility Model No. 202021004304.7, 14 pages.

* cited by examiner

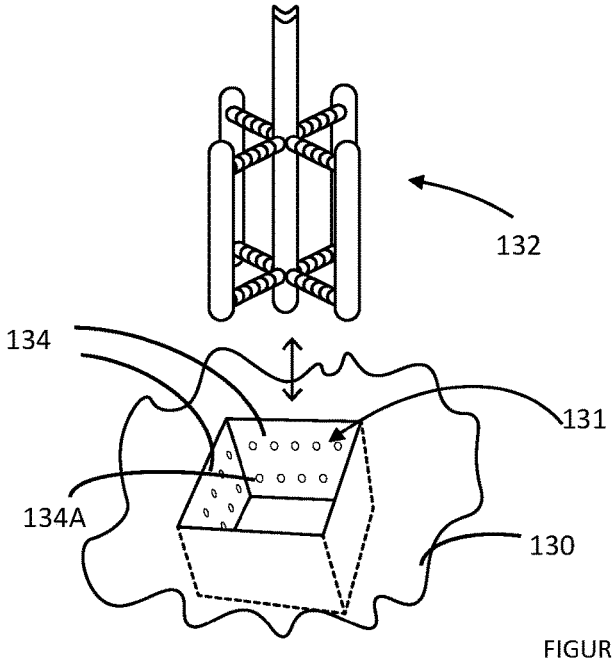
FIGURE 13a
FIGURE 13b
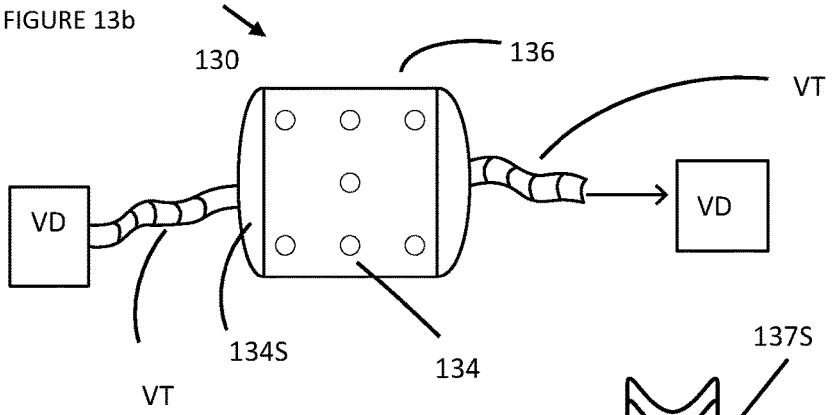
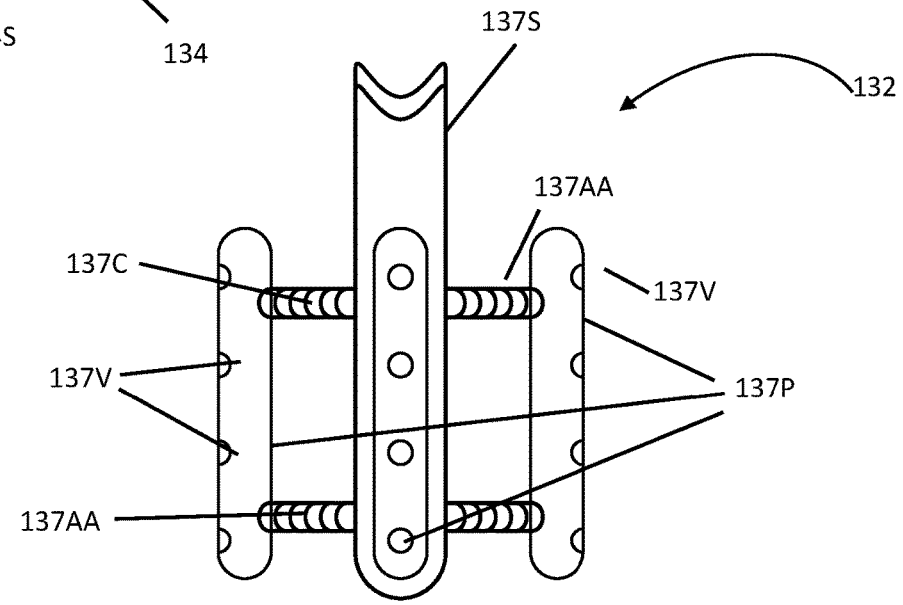
FIGURE 13c

LOW TEMPERATURE TRANSPORT AND STORAGE ASSEMBLY

FIELD OF INVENTION

The present invention relates to the field of the transportation and storage of thermally labile goods such as pharmaceuticals, and to a container system and apparatus employing a total loss evaporation agent such as dry ice. In particular, but not necessarily restricted thereto, the present invention relates to a system for the transportation and temperature controlled storage of ultra-low temperature, low volume, high value goods.

BACKGROUND TO THE INVENTION

Temperature controlled logistics relates to the storage, preservation and transportation of cargo that is sensitive to atmospheric conditions and needs to maintain a certain temperature. The chemical stability of a medicine or the physical properties thereof—in the form of sedimentation and separation of emulsion systems for example—may be affected by elevated temperatures or sub-zero temperatures. Due to the potential consequences of improperly stored drugs, the demands of national and international regulators have become more stringent and pharmaceutical companies need to be able to prove that they're products are transported via a temperature controlled supply chain. Indeed, by the use of temperature tracking sensors, pharmaceutical products are rejected in the event of any temperature excursion, as spoiled drugs can have serious consequences on the health and wellbeing. Even a brief period at sub-zero temperatures may irreversibly denature protein and lead to a loss of efficacy, and therefore such medicinal products must be maintained within a narrow temperature range above freezing point throughout the distribution chain. With individual medicine dosages sometimes costing hundreds of dollars, it can be appreciated that a temperature excursion can lead to wastage of many thousands of dollars in an individual container or carton. Minimizing the amount of time the drugs spend at ambient temperatures is critical, especially in warmer climates. Furthermore, it is important to ensure cooling apparatus remains active for the duration of the transit. Mistakes can come in the form of energy saving modes being turned on without notice, and cooling apparatus being switched off during rest periods.

The margin of error is different from product to product, but the industry has seen a greater regulatory emphasis on drugs that can maintain integrity between 2° C. and 8° C. This temperature range is referred to as "cold-chain"—a temperature range where the medicine is maintained above sub-zero temperatures. These conditions must be assured by all parties, including the manufacturer, shipper, and wholesaler. Whilst logistics operators are responsible for maintaining the temperature of a cargo, adequate labelling should be provided to ensure that specific conditions for the product are understood by all involved parties.

Some pharmaceutical goods, notably vaccines, are specified as needing to be maintained at 193K±10K, i.e. −80° C.±10° C., which is effectively approximately 80K less than typical cold chain logistics temperatures. Notwithstanding this, the same pressures of cost are present together with an arguably greater need to simplify the product—to ensure that operator error does not ruin valuable product through ignorance or otherwise. Whilst, standard 2° C.-8° C. operating procedures are known by producers, logistics companies and end users alike, vaccines may need to be deployed to areas of the world where there are no recognised cold chain procedures or where there are no appropriate storage facilities. For example, in the United Kingdom, hospitals normally possess refrigeration facilities operating to low temperatures such as −20° C., with emergency back-up power etc., it is extremely rare for −80° C. refrigeration facilities to be provided outside a hospital regularly dealing with vaccines.

Healthcare packaging solutions are necessarily validated to international standards, and typically, are "over engineered" to cope with isolated but inevitable delays. It will be noted that the amount of coolants supplied per journey/delivery/stationery emergency refrigeration facility are calculated with regard to anticipated geographical weather ambient conditions and storage facility ambient conditions for the cold chain logistics product. Phase change materials are routinely used across the cold chain industry. However, when ultra low temperatures are required other coolant systems are required. Additionally, bureaucratic demands are beginning to insist on the use of recyclable materials.

A typical product will employ temperature control systems employing passive or active stored liquid/solid phase change materials within plastics containers or have an active, powered refrigeration system. In the case of a carton employing phase change materials—which are typically maintained in the temperature range of 2° C.-8° C.—the volume and heat capacity of the goods, together with the predicted external temperatures likely to be encountered and time of travel and storage are taken into account whereby the cargo volume is maintained within the desired temperature range.

Active refrigeration systems must be arranged so that the petrol/LPG/diesel motors driving the refrigeration system is provided with fuel or, if electric, has sufficient electrical storage/mains electrical supply to ensure that a desired temperature range in a load volume is maintained, taking into account the aforesaid variables of time, external temperature and humidity. Evaporative phase change materials can also be employed in cold chain distribution, especially ultra low temperature distribution. Liquid evaporating from a surface has a cooling effect, as its molecules convert from the liquid phase to the vapour phase and escape from the surface. Energy in the form of heat from the surrounding atmosphere drives this process. In order for the molecule to leave the liquid surface and escape as a vapour, it must take heat energy with it. The heat that it takes with it comes from the surface from which it evaporated. Since the molecule is taking heat with it as it is evaporating from a surface, this has a cooling effect on the surface left behind.

Once the temperature in an atmosphere has reduced, gases therein become liquid and then solid. However, certain gasses such as carbon dioxide and nitrogen have become useful for their sublimation and evaporative properties—typically solid carbon dioxide, which is ordinarily referred to as dry ice. With reference to FIG. 1, there is shown a graph of phase diagrams of carbon dioxide (red) and water (blue) showing the carbon dioxide sublimation point (middle-left) at 1 atmosphere. As dry ice is heated, it crosses this point along the bold horizontal line from the solid phase directly into the gaseous phase. Water, on the other hand, passes through a liquid phase at 1 atmosphere. As a rule of thumb, for a carton expect a half Kilogramme of dry ice to sublimate every 24 hours. However, the exact sublimation rate will depend on the quality of the insulation provided. The lower the level of insulation, the faster the rate of sublimation—and this is factored into any determination of the amounts of dry ice that are required for any period of time of transport and storage, taking into account the varying needs of the goods, whether they be placed outside on a ground support vehicle on, for example, Miami airport on a summer's day or in the hold of an aircraft thousands of metres in the sky.

Thus, dry ice is presently widely employed—but still presents difficulties: It is essential that not only are the contents of a load volume kept separate from the dry ice, but personnel must be provided with correct safety gear to prevent unintended contact, since if personnel do not take the necessary handling precautions with dry ice, it can cause burns similar to frostbite. Indeed such burn/frostbite injuries are common when procedures have not been followed. In contrast with many storage containers, a dry ice coolant system must not be gas—tight—an increase in load volume atmospheric pressure will occur as dry ice sublimes and a resultant increase in vapour pressure needs to be released—otherwise an ultra-low temperature package could explode. As one might expect, regulations cover this and, for example, in the United States, non-medical, non-hazardous air shipments with 2.5 Kg (5.5 lb) or less of dry ice, a carton can be simply marked as containing "Dry Ice" or "Carbon Dioxide, Solid," along with a note of the contents and how many pounds or kilogrammes of dry ice are included. If there is more than 2.5 Kg (5.5 lb) of dry ice, then a Class 9 diamond hazard label needs to be applied to the package. Notwithstanding this, dry ice is a safe and effective way of shipping goods that need to stay frozen, if used properly and compliantly.

Companies operating within the pharmaceutical cold chain must be aware of the latest rules and standards in the market. The complexity of international transportation of medicines may appear nefarious but the personal and financial value of a carelessly packaged medicine leading to its destruction is significant. In the EU, the Directive 2001/83/EC determines the production, distribution and use of medicinal products in the European Union and the data is easily available. Notwithstanding this, some countries may even have safety regulation that involves physically opening and inspecting cargo, which can result in temperature deviations. Accordingly, it is good practice to make real time temperature loggers and data accessible externally from a load volume of a storage container to ensure that the opening of containers is kept to a minimum.

An additional complexity to the cold chain arises in confirming that a product has been maintained at the correct temperature, without any excursion beyond a permitted temperature range e.g. 193K±10K. The type of temperature monitoring equipment used must be able to refer to the worst-case position within a load volume (typically stated by a producer of a pharmaceutical product). The probes must be over engineered so that they are resilient to handling issues and maintain their position within the load volume. The reporting system must ensure that the monitoring is continuous and reports can be produced for transit and storage times of a product in cold chain.

Presently, there are few containers for ultra low temperature distribution: FIG. 2*a* shows a trolley bin which, whilst providing a good volume for large items, the trolley bin is oversize for vials as are commonly employed in medical supplies and vaccines, the trolley bin has no easily assembled configuration for product, the trolley bin cannot be flat-packed and present a large "dead" volume when not employed. FIG. 2*b* shows a sidewall entry system polypropylene container but, akin with the trolley bin of FIG. 2*a*, present problems on temperature monitoring and secure placement of a load. FIG. 3*a* shows a carton wherein an EPS container 31 is placed within a cardboard box 30. An absorbent material 32 and an insulation buffer pad 33 lie below a product 34—in this case a food product. Above the product, an insulation buffer pad 33, to isolate the product from direct contact with the dry ice, is provided prior to placement by dry ice 36—shown as being introduced by a nozzle 37 element connected to a dry ice supply, with a further absorbent pad 32 being provided to underlie a complementary EPS lid 38 of the container. Once the lid is in place, the cover flaps 39 of the carton are then sealed. This system has loose dry ice which cannot be prevented from getting into contact with product. FIG. 3*b* shows another form of expanded polystyrene temperature control carton where samples are maintained sandwiched between a buffer insulation layer and an outer ice pack. It will be noted that this form of temperature control, whilst compact does not permit ultra low temperatures to be maintained and positioning of temperature probes will be difficult, with ensuing compliance issues.

OBJECT OF THE INVENTION

The present invention seeks to provide a solution to the problems addressed above. The present invention seeks to provide a low temperature evaporative cooled system that can enable goods to be reliably maintained in at low temperatures for periods ranging from a few hours to several days. The present invention also seeks to provide an easy to implement method of packing and unpacking taking into account the fact that improper handling of dry ice can cause injury whilst improperly secured packages retaining dry ice as a coolant can permit product to achieve temperatures outside their permitted range of compliance, resulting in wasted product with potential great personal and financial loss.

Furthermore, the present invention seeks to provide a system for cartons—which may be transported pallet-borne goods that protects the goods and enables simple, logical packing and unpacking. The present invention also seeks to provide a temperature controlled transport/storage assembly for goods, whereby goods can be maintained within an atmosphere having a predefined, ultra low temperature range.

STATEMENT OF INVENTION

In accordance with a general aspect of the invention, there is provided a low temperature transport/storage assembly comprising an outer carton, internal insulation, a load volume and a dry ice container; wherein the outer carton is provided with a base and sidewalls and a cover; Wherein the internal insulation comprises planar elements, operably arranged to line the base and inside walls and cover of the outer carton, the planar panels of the base and sidewalls are fastened together in an airtight fashion; a first sleeve arranged to line an inside face of the base and sidewall insulation elements; a second load receiving sleeve, the second load receiving sleeve having means for spacing the second sleeve from the first sleeve, the second sleeve defining a load receiving volume; a container for dry ice comprising a base and an oppositely presented aperture for placement of dry ice therein, the base of the container for dry ice being operably placed upon the load receiving sleeve to maintain proximity above the load and any cover therefor, to enable the subliming gasses to maintain the temperature of the load at ultra low temperatures.

It is believed that the present invention can also provide benefit with the transmission of pandemic related vaccines, of particular note given recent epidemics in the Far East with SARS and C-19, worldwide, where diurnal temperatures can vary significantly—yet the medication needs to be kept cool.

Conveniently the insulation panels are fastened by one of a plastics film sheet, for example in the form of a bag either on an inside surface or an outside surface of the panels, plastics adhesive tape about adjacent insulation panels, again, either on an inside surface or an outside surface of the insulation panels. Conveniently the insulation panels are VIP panels, which are preferably protected from mechanical shock by way of shock absorbing panels.

Conveniently, the base and sidewall VIP panels are arranged without spaces between adjacent panels.

Conveniently, the cover to the outer carton is formed from tongues extending from the sidewalls, the tongues being arranged such that they can fold with respect to the sidewalls and be fastened together across a top surface of the box.

Alternatively, the cover to the outer carton comprises a separable lid with depending lips to enable securement with respect to the carton. Conveniently, at least one of the interfaces as between the lid and the upper edges of the outer carton are provided with seals. Whilst the dry ice mass will ordinarily sublimate and the increase in internal pressure needs to be relieved, it has been found that by the provision of a polymeric seal or similar, there is a reduced tendency for gas at a low temperature to flow out, especially when the outer carton is displaced from a normal upstanding orientation, during transport and upon accidental displacement. This can otherwise have serious negative consequences.

The carton can conveniently be formed from one of corrugated cardboard or corrugated plastics or high density plastics foam.

The container for retaining dry ice in use is conveniently formed from a card product such as corrugated cardboard of a sheet plastics material.

In accordance with another aspect of the present invention, there is provided a low temperature transport/storage assembly comprising a carton, internal insulation, a load volume and a dry ice container; wherein the assembly is provided with a data logger unit and a thermocouple for measuring temperature; wherein there is a load securing element within the carton formed from a corrugated or apertured material, wherein the corrugated material or apertures are parallel to a wall surface of the load securing element, whereby load temperatures can be monitored accurately, from a position close to the load volume, but not within the load volume.

In accordance with another aspect of the present invention, there is provided a low temperature transport/storage assembly, wherein the data logger unit can communicate wirelessly with IoT devices to enable data transfer between the data logger and a logistics or operator assistant.

By arranging the cartons upon a pallet, a pallet assembly in accordance with the present invention may be assembled in a rapid and expeditious manner. The parts making up the carton assembly may be stacked for storage in a relatively small space, conveniently being associated with a pallet to assist in distribution in a flat-pack style.

The present invention, can also assist in a depleting load, for example, where parts of the load are distributed across a distribution network, yet the temperature must be maintained within a specified range.

BRIEF DESCRIPTION OF THE FIGURES

For a better understanding of the present invention, reference will now be made, by way of example only, to the Figures as shown in the accompanying drawing sheets, wherein:

FIGS. 13*a*-13*e* show how insulation panels can be fixed in a gas-tight fashion in a second arrangement.

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Figure 1:
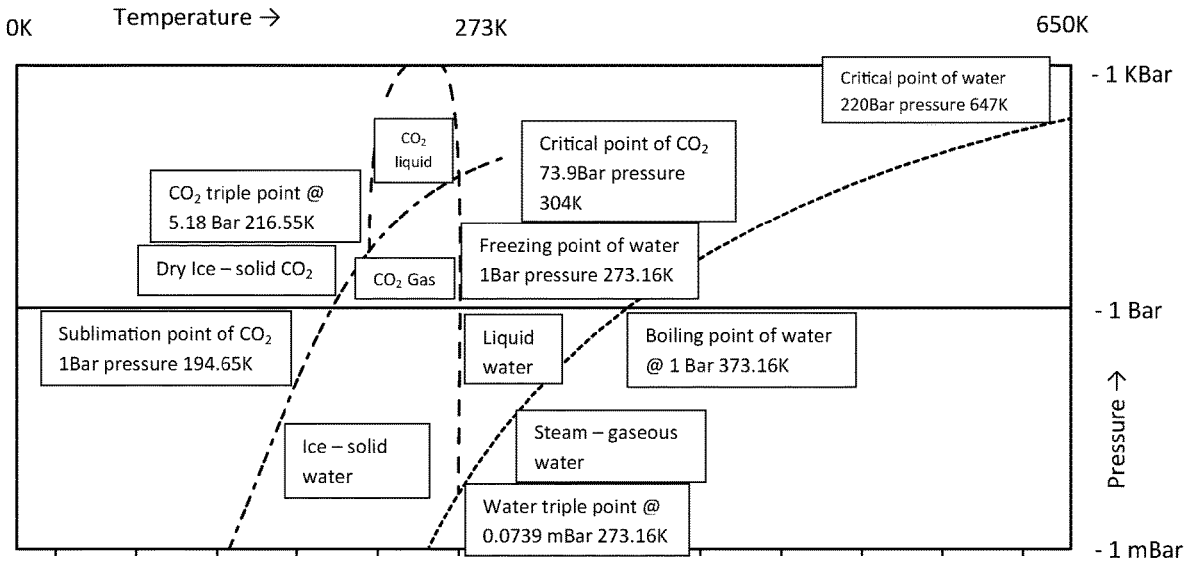
FIG. 1 shows a phase change diagrams for carbon dioxide and water.
Figure 2A:
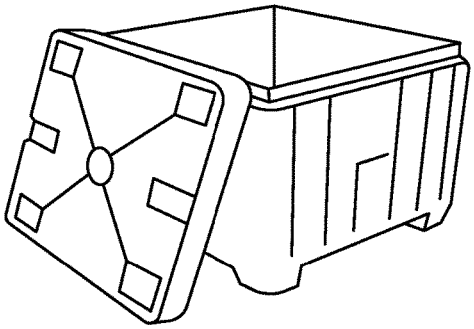
FIGS. 2*a* and 2*b*, illustrate two prior forms of plastics moulded ultra low temperature containers.
Figure 2B:
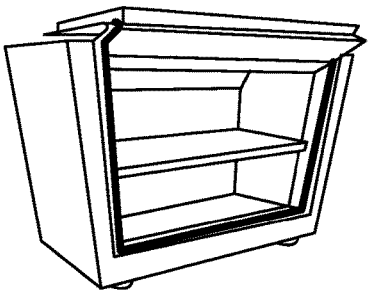
Figure 3A:
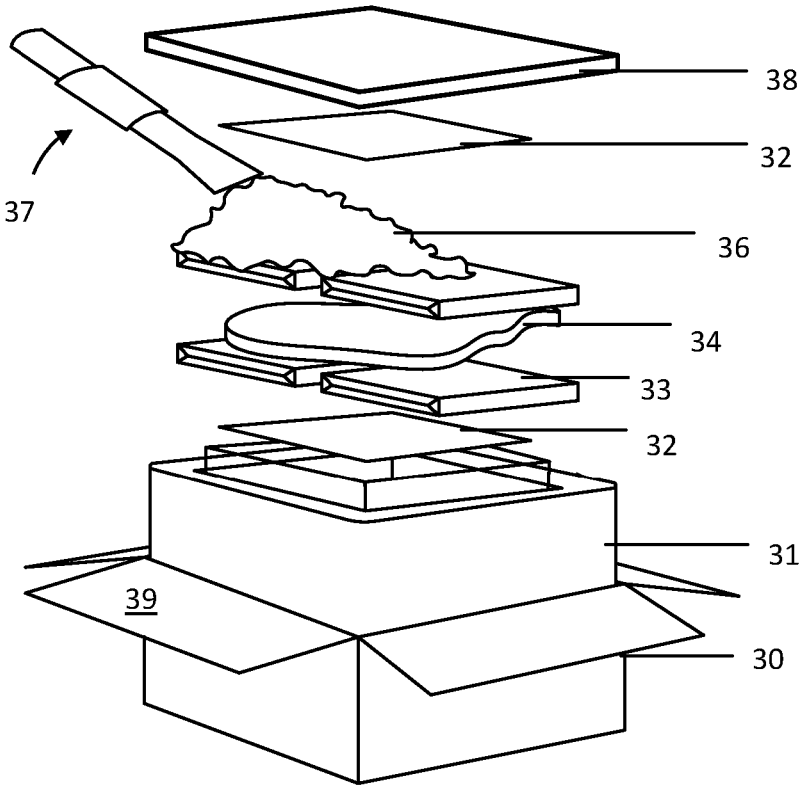
FIG. 3*a* shows a prior form of cardboard cold chain carton.
Figure 3B:
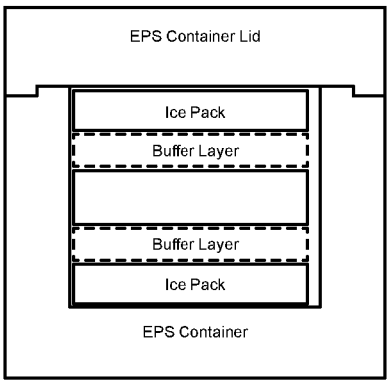
FIG. 3*b* shows a prior form of polystyrene cold chain container.
Figure 4A:
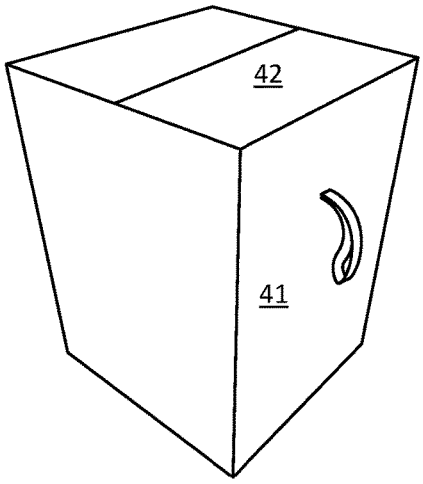
FIG. 4*a* shows a completed container in accordance with the present invention.
Figure 4B:
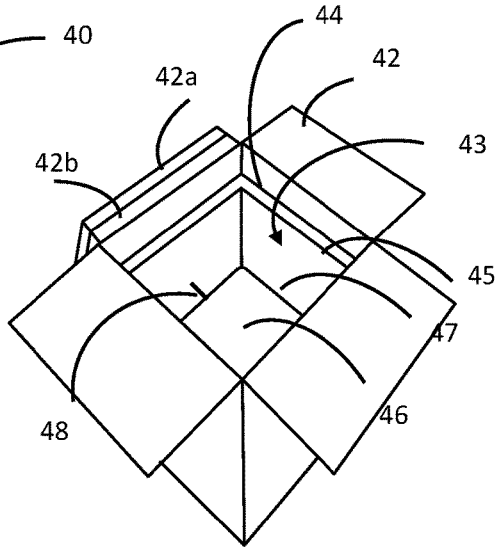
FIG. 4*b* shows the main components in perspective view of the container with the cover elements raised.
Figure 4C:
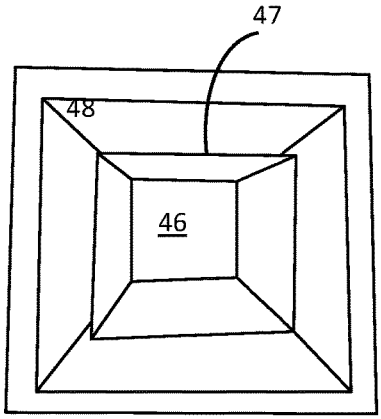
FIGS. 4*c*-4*h* show plan views of the invention during placement of dry ice and a payload.
Figure 4D:
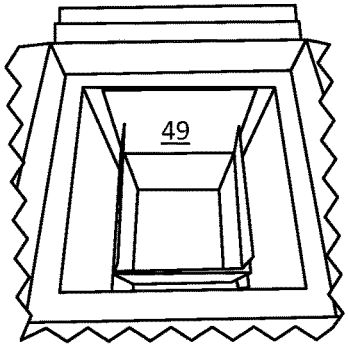

FIG. 4*a* shows a perspective view of an external view of a carton 40 in accordance with the present invention. Logistics/end user information is displayed upon the external walls. FIG. 4*b* shows a first perspective view of the carton 40 in an open state, with cover flaps 42 depending from sidewalls 41. In particular, the inside volume 43 defines a coolant and payload volume and includes a number of elements, including insulation panels 44, which surround the coolant and payload volume. Conveniently, the insulation panels 44 comprise vacuum insulation panels (VIP) as are known. These VIP panels can be easily damaged and so it is preferably provided with a protective material, for example, a panel of e-flute cardboard 45, having a thickness of 2 mm, which provides simple and adequate protection. Conveniently, the VIPS are contiguously arranged together whereby, once installed within the external, four sided carton, there are only four non-contiguous edges as between each adjacent pair of edges of the five panels, with such panels being secured with, for example, so-called "sticky-back plastics tape" (not indicated) so as not to compromise heat sealing efficacy by reason of a passage of air between such adjacent pair of non-contiguously arranged VIP panels. The tape is conveniently reinforced with fibre, as is known. Sleeve element 47 defines the actual payload area and simply provides a sleeve into which vial cartons can be placed, as are frequently employed in ultra low temperature vaccine and medicament supply. Vials are small plastics or glass containers—analogous to truncated test-tubes—each vial being provided with a secured lid. Sleeve element 47, conveniently made from d-flute cardboard, rests upon a base 46 of the inside surface of the defined coolant and payload volume 43, yet is spaced from the inside wall 45, by a distance 48 which permits coolant such as dry ice to be placed therein. Dry ice can be decanted by way of a dispenser with a nozzle as is shown in FIG. 3*a*. The distance 48 between the sleeve element and the inside wall 45 can be determined by die cut tabs extending from the corners of the sleeve element when fabricated by standard die-cutting techniques. This also permits the fluting to be exposed—which provides a secure placement for a thermocouple lead temperature sensor as shall be discussed below. In FIG. 4*c*, there is a single cardboard sleeve element 47 (e-flute), which has upstanding walls, which are folded over at the top. In contrast, FIG. 4*d* shows a two-part sleeve, wherein a top sleeve 49 telescopes with respect to an outer, lower sleeve 47. This configuration ensures that an upper container which retains dry ice can remain in close proximity to the payload, which comprises vials within cardboard box containers, of approximately 230 mm square.

Figure 4E:
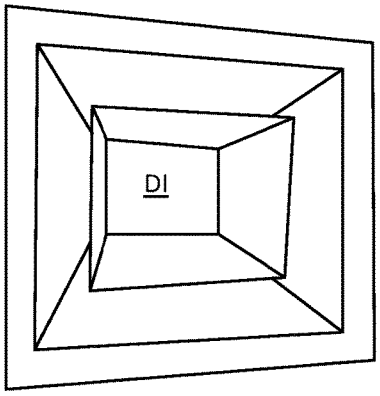
Figure 4F:
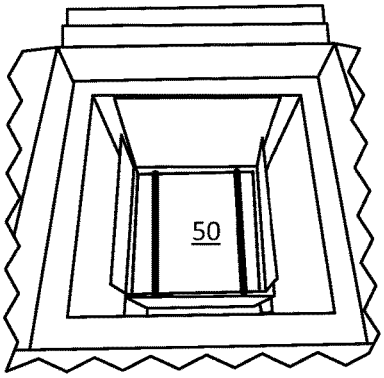
Figure 4G:
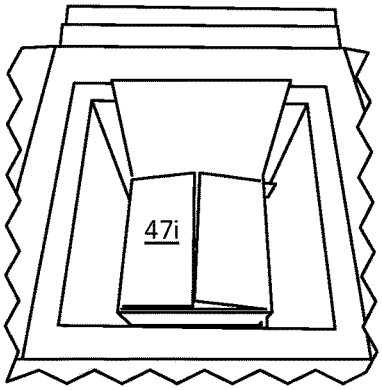
Figure 4H:
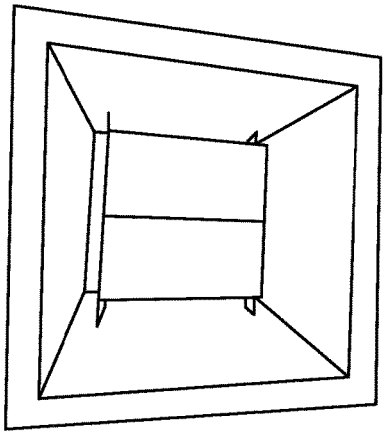
Figure 4I:
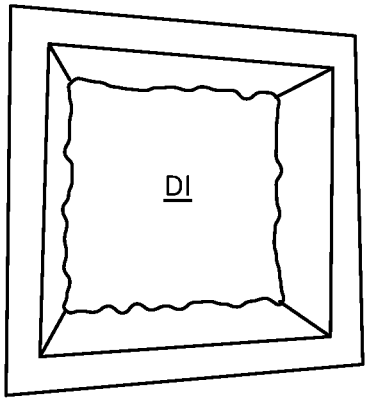
FIG. 4*i* shows how the sleeve components to the load compartment can operate.

FIG. 4*e* shows the next stage of filling a container when dry ice DI is placed. Dry ice, as mentioned above, tends to sublime rapidly at room temperature and appears smoky in this figure. An insulation buffer may be provided prior to the placement of vial packaging as is known. FIG. 4*f* shows a vial package 50 having been placed within the load sleeve 47. Following this one of cover flaps extending from the internal sleeve 47*i* are placed over the packaged vials 50 and folded over an internal telescoping cover sleeve with a closed upper aperture is placed over the product—per FIG. 4*g*. FIG. 4*h* shows how the flaps 47*i* of a single sleeve element are closed. Subsequently, dry ice DI is placed over the cover flaps 47*i* of the sleeve, telescoping 49 or otherwise 47 and between the product sleeve 47 and the inside walls 45—per FIG. 4*i*. In a packaging facility, by automation means or otherwise, the dry ice which is ordinarily provided by means of a flowable solid, will be dispensed in measured amounts and then shaken, to permit settling so as to attain a minimum volume of dry ice. Given that the dry ice is provided in quantities to correspond with an anticipated transport and storage period, insulation spacer means may be provided to reduce the total amount of the dry ice product, to maintain costs in a logistics environment.

Figure 4J:
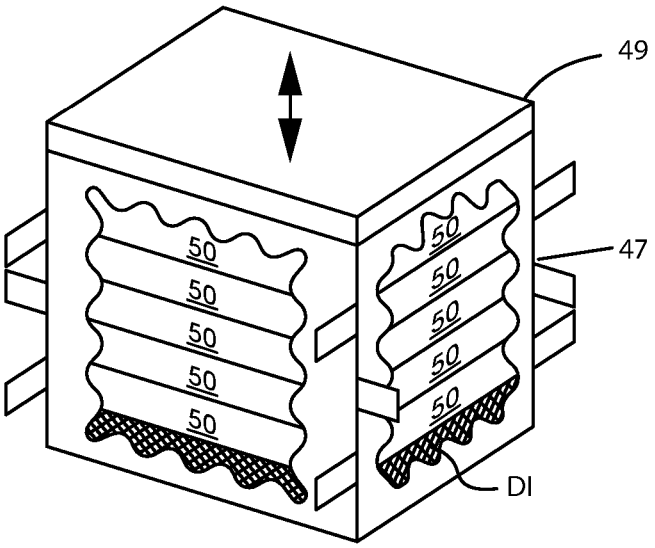
FIG. 4*j* shows a sleeve comprising an inverted five sided box.

It will be appreciated, especially when vial packages are removed that the requirement for load space is reduced. With reference to FIG. 4*j*, it will be see that sleeve 48 comprises an inverted five sided box, with an open end, the open end facing downwardly and about vial packages 50, which packages 50 are retained within the load volume by product sleeve 47 and slidable sleeve 49 having the closed end. Given that the load spaced is reduced and to maintain thermal contact arrangement, to ensure continuity of thermal profile over time, the sleeve in operation moves downwardly. This movement of the slidable sleeve, changes the volume of the coolant area. The materials of the sleeve are ideally provided with a smooth finish and ideally with an aqua-phobic coating whereby to prevent any atmospheric water vapour sticking to adjacent surfaces thereby to prevent adjacent surfaces from becoming stuck together.

Figure 5A:
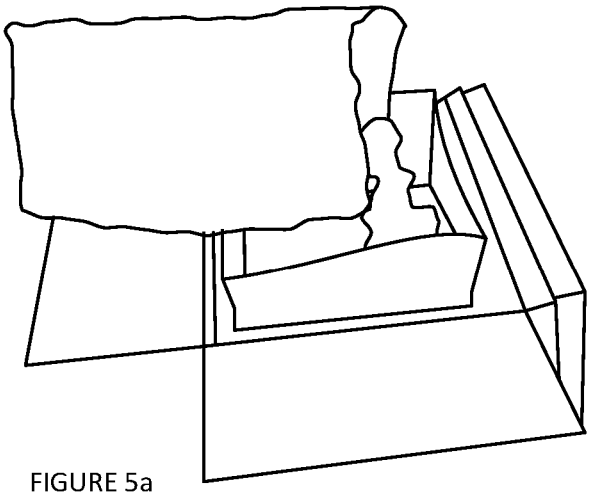
FIGS. 5*a*-5*b* detail aspects of the dry ice container and how it can be deployed.
Figure 5B:
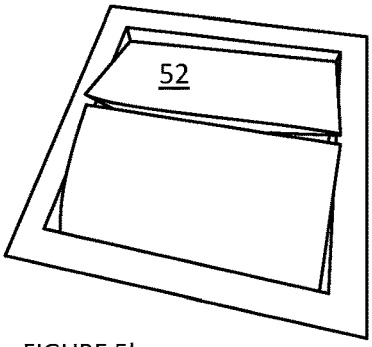

Referring now to FIG. 5*a*, there is shown a container 51 with a flat base to support dry ice above the load and above then peripheral channel about the load, within the interior of the carton 40. In fact, the Figure shows dry ice being decanted into the container. The container is of low thermal resistance (0.0056 $m^2KW^{-1}$) and is adapted to be flat-packed when not in use and can be made from a sheet material such as cardboard or other material that does not deteriorate in ultra low temperatures. Once the required amount of dry ice has been provided, the cover—meaning the extended walls 52 to the container can be folded over.

Returning to FIG. 4*b*, once the dry ice container has been filled with dry ice and the covers 42 are folded over, noting that one of the cover panels also comprises corresponding vacuum insulation panel element 42*a* and a shock absorbing panel 42*b*— conveniently formed form expanded polystyrene, to absorb physical shocks and protect the inside thermal insulation panel 42*a*, noting, as above that VIP materials tend to be more fragile than, for example, polystyrene. It will be appreciated that, below the base VIP panel, there will also be similarly provided a shock absorbing panel to protect the base VIP element.

Figure 6A:
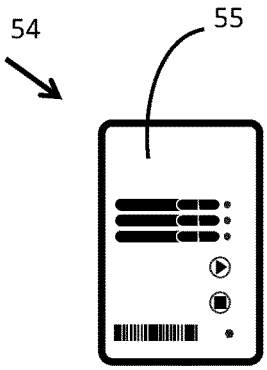
FIGS. 6*a*-6*g* detail aspects of a real time data logging assembly and controls therefor and how sensors are mounted within the carton.
Figure 6B:
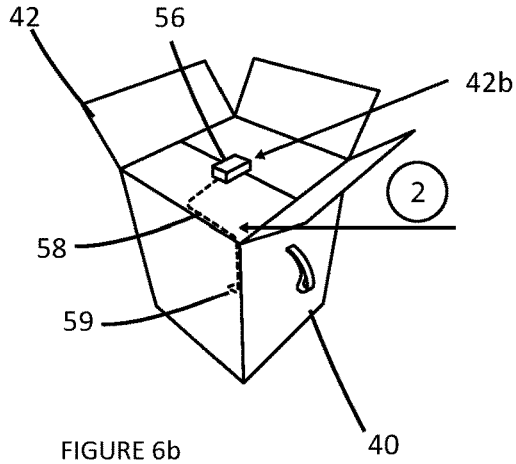
Figure 6C:
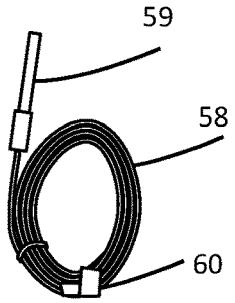
Figure 6D:
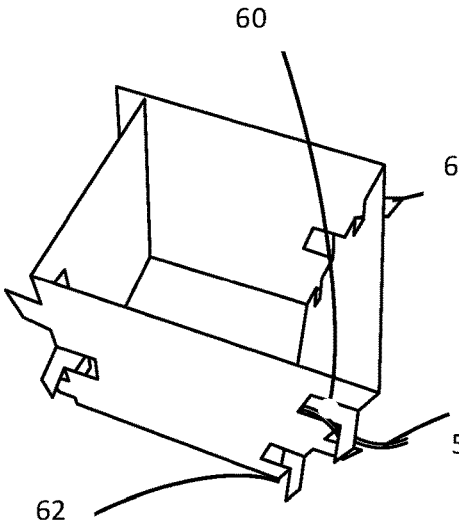

Ultra Low temperature logistics must at all times be subject to temperature monitoring, to ensure conformance with design performance for a particular load. FIG. 6*a* shows a data logger 54 having a control face 55 which provides switches to start data recording of a shipment—once the dry ice has been placed (note that this must not be determined from an intended pick-up time of arrival of a logistics operator). This control element 54 is connected to at least one thermocouple element 59, per FIGS. 6*b* and 6*c*, which show the container 40 and thermocouple arrangement respectively. The control element is retained within the shock absorbing element 42*b* of the lid element and is connected to at least one thermocouple sensor 59 via wire 58. It will be appreciated that the real time monitoring capabilities are supported by blue tooth transmission protocols to communicate with an operator reader and/or a separate control system for remote monitoring. FIG. 5*c* show an exemplary thermocouple 59, complete with control wire 58 and plug-in connector 60 whereby to fasten to a control element, noting that many may well be pre-configured upon assembly during manufacture and it will also be appreciated that more than one sensor may be installed within the load containing/positioning sleeve 47. FIG. 6*d* shows a detail of a cardboard sleeve element 47 wherein the flutes of the d-flute board provide an appropriately sized containment aperture: the elongate tip defined by the thermocouple 59 is snugly retained within a flute hollow 61. The flute hollow 61 opens at a distance to the wall 45 of the inside face of the container sufficient to prevent the thermocouple sliding out and becoming loose, proving incorrect data—if not otherwise detected. Conveniently, the tabs 62 extending to enable secure positioning of the sleeve with respect to the walls 45 of the coolant—load volume 43. This scheme of fixture is equally relevant whether the corrugated material is cardboard or of a plastics extrusion, ensuring that the temperature probe remains in position, noting that by being within the flutes of the corrugated material, the probe is not within the load compartment as such. FIGS. 6*e*-6*f* show the assembly from different angles—noting that in FIG. 6*e*, the four sided sleeve is shown in a folded fashion, enabling access if required to remove the sensor 59. In FIG. 6*f*, it is clear that the temperature sensor is very close to the load volume but does not impinge on the load volume at all, enable unrestricted access to vial containers 50 and the like.

Figure 6G:
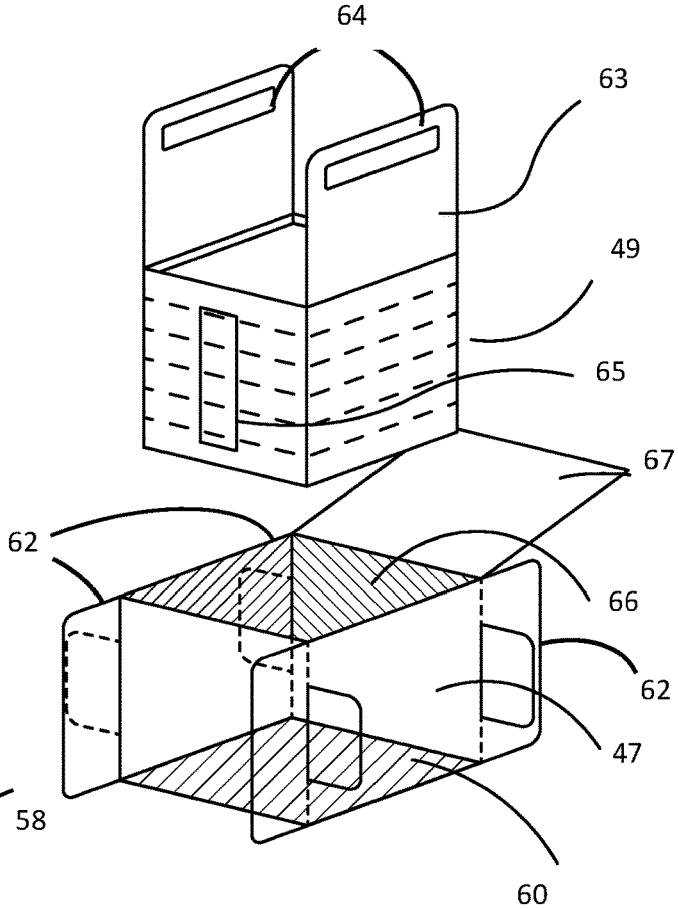
Figure 6E:
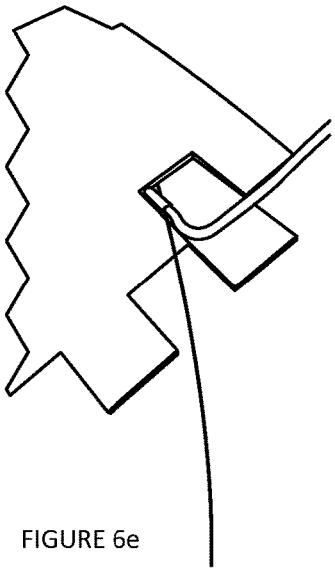
Figure 6F:
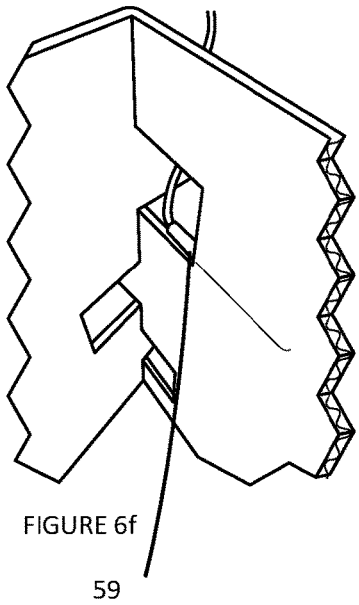

FIG. 6*g* shows an alternative payload carton assembly wherein sleeve assembly 47, 49 comprises an upper sleeve structure 49 having two foldable covers 63, each cover having an aperture 64 to assist a manual removal—using suitable gloves, bearing in mind the extremely low temperature. A slot 65, provide visibility to the number of vial tray present within the payload carton. Inside surface 66 of lower payload carton 49 is provided with a low friction coating, which is preferably hydrophobic, to minimize the attraction of water molecules, which will always be present in an atmosphere, whereby the likelihood of icing will be reduced. It will be appreciated that alternate methods of ensuring access can be provided, for example, by way of the provision of thin sheets of plastics material. It will be appreciated that liquids such as oils and the like at STP are likely to be solid or extremely viscous greases at reduced temperatures. Special laminate materials may be required for longevity. Hingedly attached to one of the top surfaces of the walls of the base payload container is a cover flap 67, which acts to prevent loose dry ice form entering the lower payload compartment when a payload has been removed. The base 47 is conveniently formed as a five-sided structure to provided structural integrity, noting that dry ice is placed to the outside of thereof; a lower surface of the base is provided to ensure that dry ice external to the payload carrier does not deform the container when removed for removal of some of the contents; the surface can be arranged as a non-stick, optionally dimpled surface, to assist in preventing removal of the upper payload cover/vial trays.

Figure 6H:
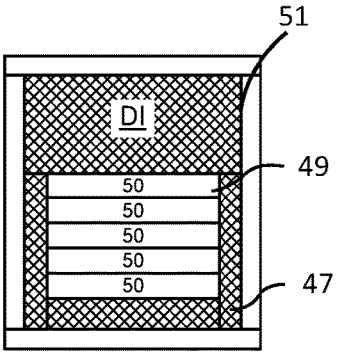
FIG. 6*h* shows how the present invention can operate in section through a carton.
Figure 7A:
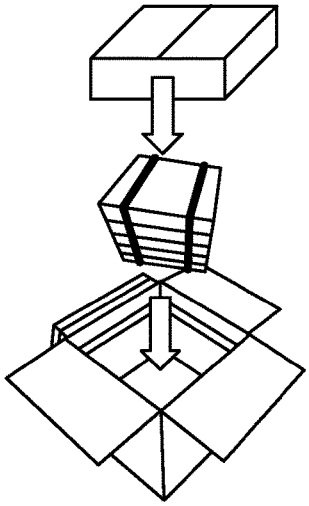
FIGS. 7*a*-7*d* show how the system can be deployed in a packing out procedure.
Figure 7B:
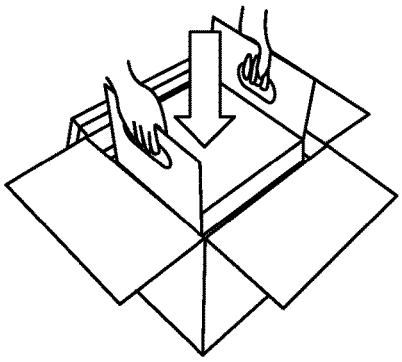
Figure 7C:
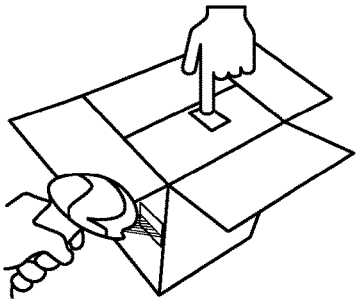
Figure 7D:
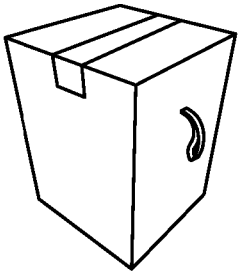

FIG. 6*h* shows the status of the carton upon loading of the goods, with vials 50 placed upon dry ice in the sleeve assembly, 47, 49, with dry ice in the upper container 51, importantly, the base is in contact with the top of the sleeve 49, ensuring that the temperature within the load sleeve arrangement 47, 49 is maintained. After a period of time—typically a few days, the dry ice volume will have depleted through sublimation—the volume of gas will escape through the small gap that will exist between the side walls and the lid of the carton In view of the number of steps taken in packing and unpacking product from the carton in accordance with the invention, it will be appreciated that instructions for loading and unloading can be followed quite simply, conveniently using non-linguistic figures, as shall now be discussed. FIG. 7*a* shows how vials 65, strapped together by means of straps 66 can be placed within a load sleeve, FIG. 7*b* shows how the dry ice container can then be placed upon the product—using gloved hands to protect the user's hands from freeze-burns. It is noted that the polyethylene material of the container has such a low thermal capacity any accidental touching of the material; even at ultra low temperatures is unlikely to cause ill effect to an operator. In FIG. 7*c* the first cover 42*a,b* is placed over the folded covers of the dry ice container, the control element switched on and then the last two cover panels 42 are taped in placed—whereby the ultra-low temperature product can begin its journey, per FIG. 7*d*. Note however, that when the carton is employed as an effective ultra low temperature storage facility for an indefinite period of time, the dry ice—which continuously sublimes—can be re-filled to ensure that the temperature of 193 K is maintained.

Figure 8A:
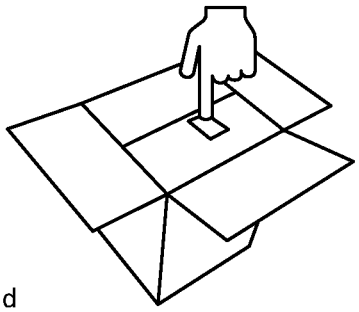
FIGS. 8*a*-8*d* show how the system can be deployed in a product removal procedure.
Figure 8B:
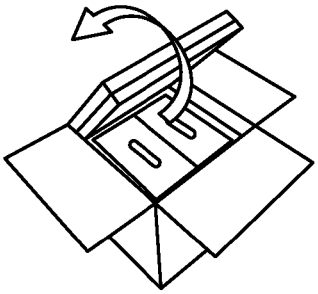
Figure 8C:
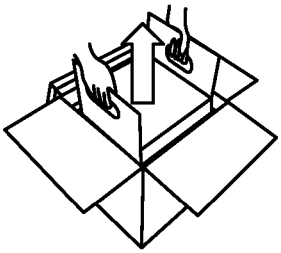
Figure 8D:
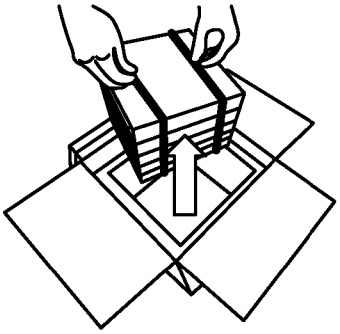

FIGS. 8*a*-8*c* show how simple the steps in retrieving product at low temperature can be. In the first instance the first three covers 42 of a container 40 are folded back after the release of a tape through cutting or otherwise, whereby to expose the temperature logger. The logger data pad is activated to indicate the nature of the opening (emptying product completely or just to indicate that one or more vials are removed); the fourth cover is then removed, together with the VIP and mechanical impact absorption material 42*a*.

It will be appreciated that the cardboard employed for the construction of this invention can use sheet materials that are generally available, from multiple vendors; indeed, the present invention is not restricted to the use of cardboard products per se, but it is widely employed and can be recycled in a simple fashion. It is to be noted that certain plastics may become too brittle at low temperatures, although plastics do not suffer from becoming wet—other than consequential matters arising from the presence of water. Notwithstanding this, there are several standard waterproof grades of cardboard with differentiators including the weight of the papers and the flute profiles, as well as the number of corrugations, the use of wet strength resins and wet strength adhesives to give good-excellent performance in moist or humid conditions. It is also possible to coat the board to provide further moisture protection, for example.

In the manufacture of the carton, several types of sheet material can be employed. Indeed, whilst cardboard is relatively environmentally friendly, can be re-used other materials can also be employed; Card/paperboard, plastics sheeting, formed plastics panels, corrugated plastics sheeting and other sheet materials can be employed, the choice being determined upon requirements for specific use, such as weight to be supported, number of uses expected and such like.

Conveniently, the insulation material would comprise of VIP materials for best results, but other insulation materials could be employed, such as expanded or extruded polystyrene or polyurethane foam. Notwithstanding the above, any insulation material must have sufficient physical properties that they do not become too rigid and brittle at low temperatures.

Figure 9A:
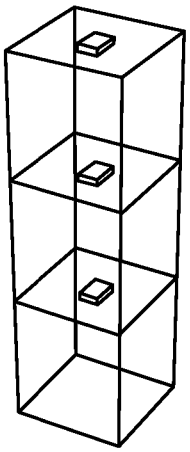
FIGS. 9*a* and 9*b* show how cartons can be stacked and arranged upon a pallet, respectively.
Figure 9B:
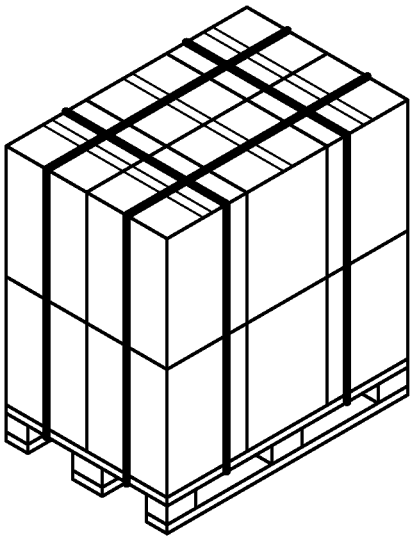

FIG. 9*a* shows how carton in accordance with the present invention can be stacked. In addition to the provision of single cartons, the present invention can be multiply deployed by the use of pallets and derivative containers, such as cartons that can be packed in groups of six upon the foot print of a Euro-pallet, for example. A Euro Pallet—has dimensions of 1200 mm×1000 mm. Such pallets and derivative containers have a weight ranging from tens of Kilogrammes to a ton or more and are transported in ships, lorries & aeroplanes and tend to be employed in normal distribution channels taking several hours, if not days to complete a distribution. Cardboard cartons of a few litres in load volume—but requiring a transport package space of 50-90 litres are also employed on local distribution routes. It will also be appreciated that the invention can be provided in a variety of sizes, in accordance to specific requirements.

In development of the present invention it has been noticed that upon the occurrence of displacement of the carton during handling and travel, that the dry ice sublimation characteristics can be counter-productive. For example, with reference to FIGS. 10*a* and 10*b*, a carton 40 is shown initially upright and then in a position 90° to the upright position. It has been found that due to the density of dry ice, once tipped over, carbon dioxide gas will tend to flow out of the shipper through lid, as indicated by reference numeral 100. Ambient Air is then drawn into the lid, as indicated by reference numeral 101. The effect of the ambient air being introduced within the carton accelerates sublimation rate, with an effect of reducing the temperature below −90° C.—i.e. this permits super-cooling to occur. It has been found that the inner carton and lid assembly can be modified in one of two ways, noting that these are fastened so that there are no gaps between adjacent panels, as is known and also disclosed in certain co-pending patent applications to present applicant. A continuous seal about the interface of the lid and carton such as a gas-tight polymeric seal 103 can be provided which gives a substantially gas tight seal under normal pressures, reducing a likelihood of escape of carbon dioxide gas will tend to flow out. The seal can be provided in a number of ways: there could be a single seal 103 placed upon the upstanding edges of the walls 44 of the carton 40; there could be provided a single seal upon the lid 42*a*, around the contact edges, noting that it has been found convenient to have a foam seal of 10 mm in thickness. In particular, a 30*g*/l density cross-linked ethylene vinyl acetate copolymer extruded foam has successfully been employed, with the foam being affixed to the whole of an inside surface of the lid 42*a* whereby it can be easily fitted in production, without great tolerance issues being of concern. The skilled man will be aware of various alternatives, noting that at low temperatures, the behaviour of foams will differ. Indeed, there could be a seal provided on both the upstanding edges of the walls and the lid. It is believed that the fastening of lid (which is practice will be adhesively fastened to the inside lid 42 of the outer carton 40) together with the seal or seals, and subsequent fastening of the flaps of the lid can enable the internal pressure within the load volume to increase as the dry ice sublimates, preventing ambient air from entering, since ambient air will be at a reduced pressure relative to the load volume. In a further alternative the foam could comprise an edge portion of a plastics bag that lines the inside of the insulation panels. The bag could be replaceable, so that it is ensured that the seal is replaced as a matter of course.

Conveniently, the walls of the outer carton 40 are formed so that they fold reliably at a specified length relative to the height of the internal carton, such that when the top flaps of the container are closed and adhesively fastened, as is known, a substantially uniform increase in pressure can be achieved, when filled with dry ice. For example, opposing flaps could be permitted to meet at the top and then an adhesive tape be applied to secure the flaps in abutment, whereby in a packaging line, fastening by tape could be simply and reliably performed.

Figures 10A, 10B:
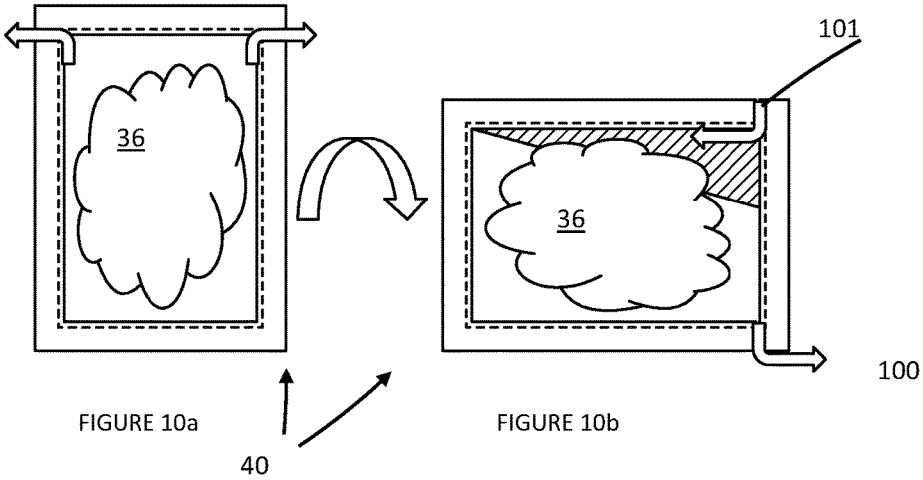
FIGS. 10*a*-10*f* show schematic representations of a carton indicating how sublimation gases expire and how they can be controlled.
Figure 10C:
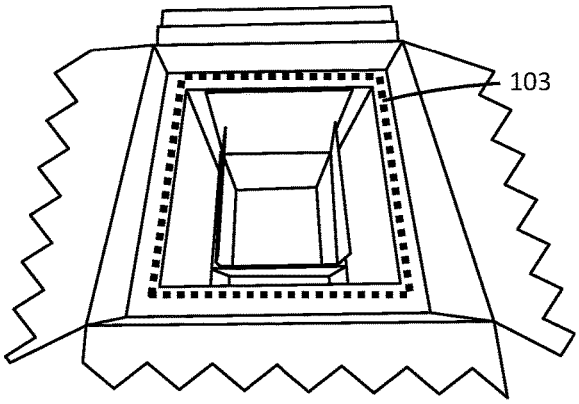
Figure 10D:
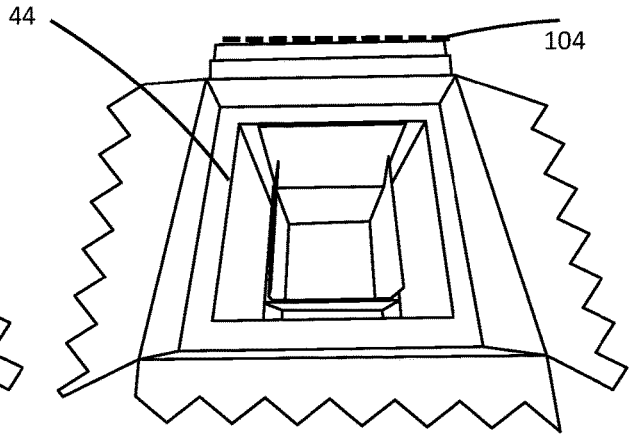
Figures 10E, 10F:
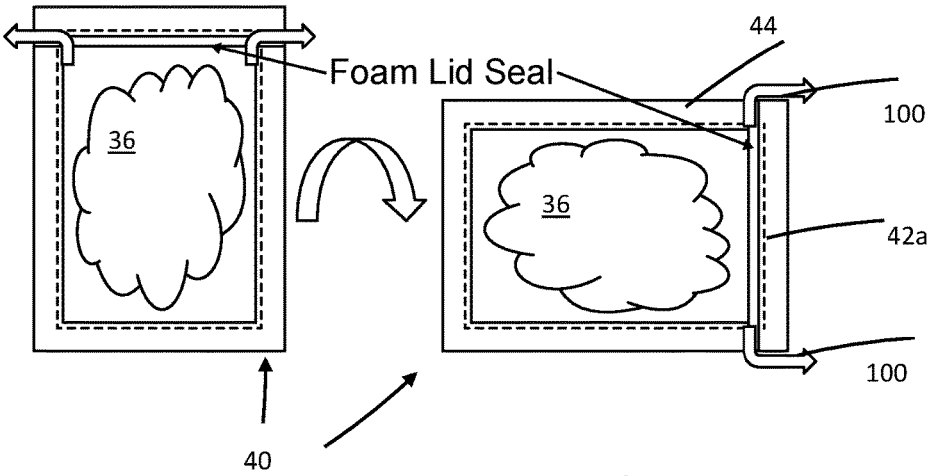
Figure 11A:
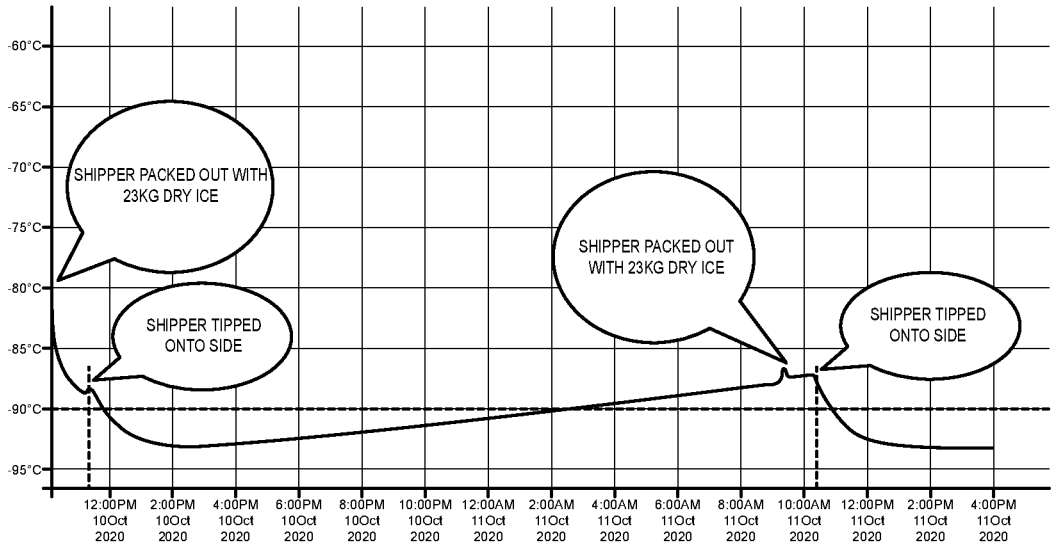
FIGS. 11*a* & 11*b* show schematic representations of a temperature profile of a carton without and with gas control seals.
Figure 11B:
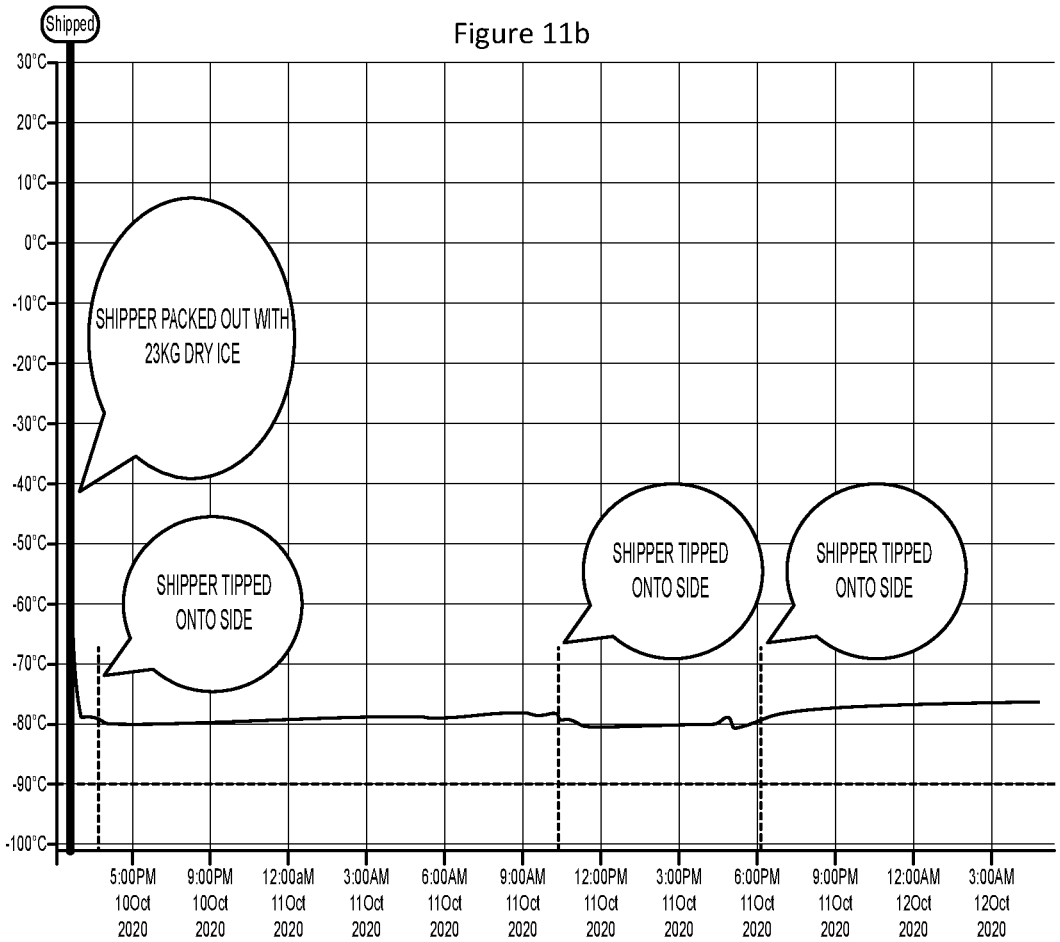

With reference to FIG. 10*e*, it is seen, that under normal conditions, the sublimation pressures will still cause escape of the carbon dioxide gas, yet when the shipper is tipped over per FIG. 10*f*, then it has been found that whilst carbon dioxide will still tend to escape through surface tension effects or otherwise, it has been noticed that, as the dry ice sublimates such that the carbon dioxide gas continues to vent from the shipper. The Lid Seal does not allow Ambient Air ingress, preventing accelerated sublimation rates and substantially maintains the correct sublimation temperature. FIG. 11*a* shows a graphical representation of a temperature profile of a carton having been packed out with 23 Kg of dry ice, with the carton as shown in FIGS. 10*a* and 10*b* which is then subjected to displacement by the carton or shipper being displaced on its side. It will be seen that upon each incidence of being displaced, the temperature has fallen below 90° C. As will be appreciated, in the event that the temperature extends beyond a desired range, this will potentially compromise the product. FIG. 11*b* shows a graphical representation of a temperature profile of a carton having been packed out with 23 Kg of dry ice, with the carton as shown in FIGS. 10*e* and 10*f* which is then subjected to displacement by the carton or shipper being displaced on its side. It will be seen that upon each incidence of being displaced, the temperature did not fall below the 90° C. threshold—that is to say the foam seal prevented ingress of ambient air and therefore any overcooling; the foam seal permitting egress of sublimating gas, in effect acting as a one-way seal. It will be appreciated that in the cold chain industry, quality control procedures through examination of data loggers associated with each and every carton will confirm whenever there has been a temperature excursion outside permitted range, resulting in wastage of product. However, one should not think of this merely as a product that needs to be replaced, the wastage can be costly in terms of expense and, in the case of medicines, dire consequence could ensue to the health of a potential patient or group of patients. Additionally, in terms of cold chain supply the business confidence in a transport company could well have significant contract ramifications. In the alternative, the foam could be provided along the top edge of the upstanding insulation panels. In a further alternative the foam could comprise an edge portion to a plastics bag that lines the inside of the insulation panels.

Figure 12A:
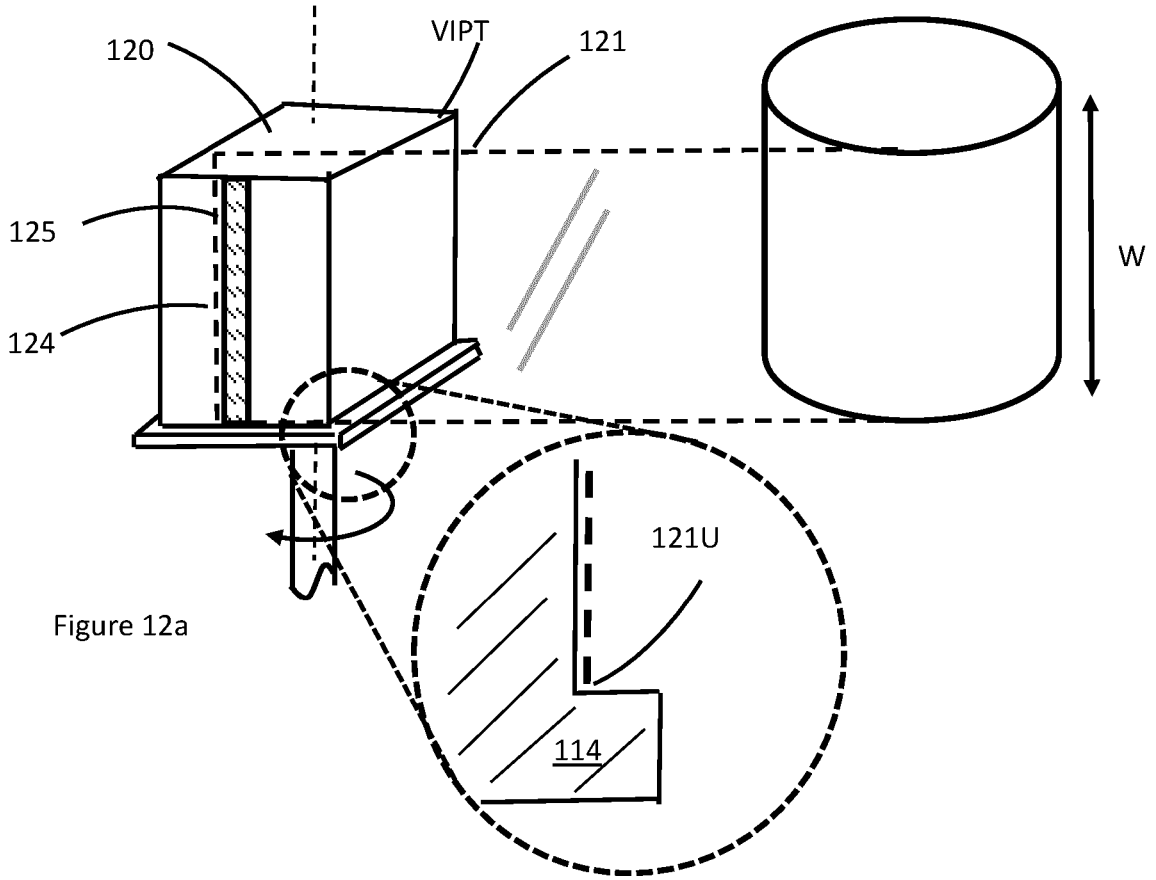
FIGS. 12*a* and 12*b* show two figures showing how insulation panels can be fixed in a gas-tight fashion in a first arrangement.
Figure 12B:
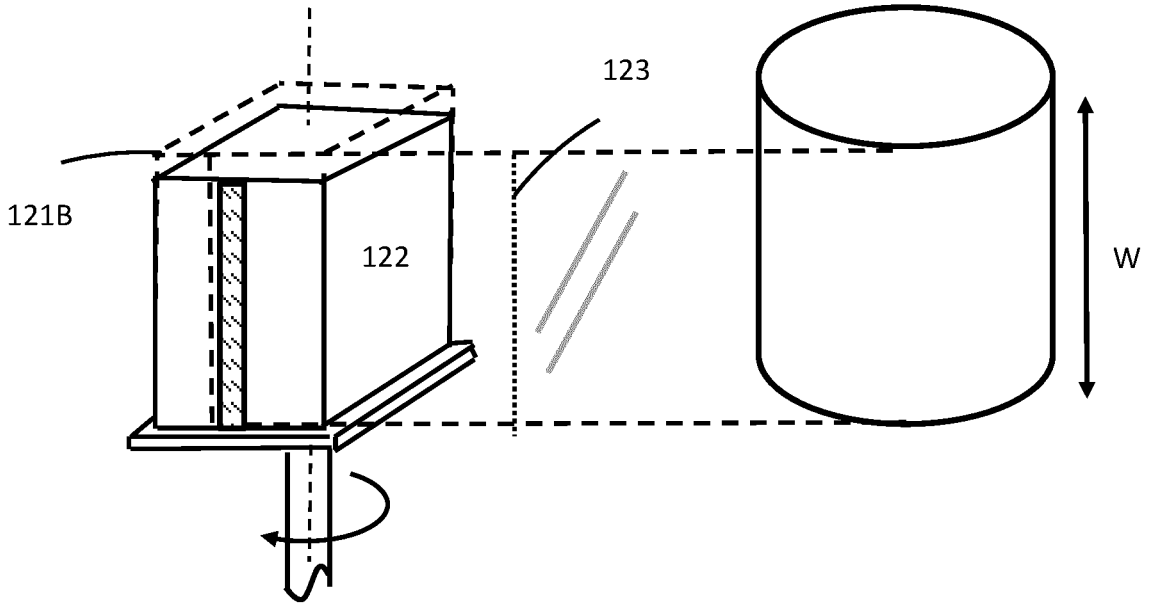

In accordance with another aspect of the invention, there is provided a further variant in the method of fabrication, as shall now be discussed with reference to FIGS. 12*a* and 12*b*. Referring initially to FIG. 12*a*, in accordance with this aspect of the invention, a first layer of adhesive tape 121 is attached to a mandrel 110, with the adhesive layer being on a side of the tape directed away from the mandrel, necessitating the use of a low-tack adhesive pad 125 associated with the mandrel and for placement of a leading edge 124 of the tape, whereby the tape can be secured during assembly. The pad 125 is conveniently capable of being separated from the surface of the mandrel, to enable a removal of the assembly once manufactured. In the alternative, a mechanical grip element could be used, whereby a mechanical grip can be easily released upon removal of the finished assembly. Equally, low tack double sided tape could be employed to enable placement of the leading edge 124 of the tape 121. With reference to the inset portion, it will be seen that the lower edge of the tape 121U is placed such that it is brought to the ledge element 114 of the mandrel. The mandrel is then rotated, and as shown in FIG. 12*b*, the adhesive tape 121B fully surrounds the mandrel such that once aligned, insulation panels can be affixed thereto, noting that the placement of insulation panels, whether VIP or other types of panel must be carefully aligned. It will be appreciated that this is followed by a cutting of the tape along line 123, conveniently perforated to assist in the separation of tape following the completion of the formation of seals and a placement of the upper part of the tape 121B transversely with respect to the sidewalls, on surface 122 of the mandrel, to complete the sealing of the gaps between the panels. The corner sections could be sequentially cut and folded whereby the outer adhesive film of a corner section is employed to secure he underside of the adjacent adhesive film, which is performed for the sequential corners. In the alternative, as with the side elements, a low tack pad could additionally be provided or a separate low-tack double-sided adhesive tape. An additional layer of tape could be provided, in correspondence with the surface 112 of the mandrel.

The particular tape employed needs to be operable at low temperatures and it has been found that polypropylene tapes can be used at low temperatures, especially when reinforced by fibre/mesh. Whilst it seems that tape manufacturers such as Intertape Polymer Group and 3M do not recommend the use of their tapes at low temperatures, inventors have determined, that, nonetheless e.g. 3M VHB tapes have fared reasonably well in exceedingly cold temperatures. It is also possible to use shrink wrap tapes—commonly employed for retaining goods on a pallet; the films are stretched and then heated to tauten the wrap and secure the panels. Other types of tape can also be used such as mono-oriented polypropylene (MOPP) film, which is a film which has an ability to stretch in a direction of application. It has been found that tape with reinforcement fibres can assist in the integrity of a tape, such as by the use of glass-fibre reinforcement. The fibres assist in the maintenance procedures, since, when using a low adhesive bond the tapes can be removed, when replacing, for example one or two damaged insulation panels. Inventors have found that a range of formulations of silicone, rubber and acrylic adhesives can be employed and are known form applications such as re-sealable food packaging, powder coat paint masking, glazing, touch screens etc. It will be appreciated that latent residue could change the dynamic of any subsequent wraps that will arise in maintenance issues. It is known that typical widths of such films available in practice range from a couple of centimetres to a couple of meters, which is sufficient for the intended use of fastening insulation panels. During development, it was also noted that several tapes would tend to delaminate—i.e. a tape could not be completely be removed, which might affect intended performance or ability to be processed in a remanufacturing process.

Referring to FIG. 13*a* there is a receiving element 130 comprising an inset reception area 131 and a film insert device 132. The receiving element comprises a vacuum device VD operable to surround the reception area, with the reception area being defined by panels 134, which have apertures 134A set within. The reception area defines a volume operable to receive a carton 135 having insulation panels 135IP placed within, the insulation panels 135IP being spaced within the carton, around a load for temperature control purposes, with gaps arising between the edges of adjacent insulation panels. FIG. 13*b* shows a view from one side, below a surface 136 of the receiving element 130, where the internal panels 134P of the reception area indicated are visible, with a shroud element 1345 enclosing the internal panels 134 and having one or more vacuum tubes VT connected to one or more vacuum devices VD.

Turning now to FIG. 13*c*, there is shown a bag receiving and placement insert component 132, which is used to place a tubular film of plastics, conveniently in the shape of a bag, which is operable to pick up or otherwise deploy a bag/plastics film so that the bag or film is of a reduced diameter upon initial placement with the receiving element 130, in use, when it is inserted into a carton or box 135, as shall be explained with reference to the following figures. Notwithstanding this, the insert component comprises a main shaft 1375 which, at a distal end thereof, is provided with four actuating arms 137AA, which extend outwardly from a retracted position to an extended position in use, and are respectively connected to a positioning element 137P, at corresponding distal portions thereof; at a proximal portion of the shaft and at possibly one or more sets of intermediate positions relative to the insert shaft, proximate and possibly one or more sets of intermediate actuation arms are provided. The actuation arms can conveniently comprise a hydraulically operated ram as shown with reference to 137C, noting that ordinarily it is preferable to provide a tubular protective member to protect the cylinder, although other types of linear actuators could be employed such as electric linear actuators. The plastics bag or film 138 is arranged around the positioning elements 137P, when the actuating arms are retracted. Vacuum retention apertures 137V may be positioned about an outside surface of the positioning elements, whereby the positioning element 137P can retain the plastics film or bag. It will be noted that in the figures a generally square section container is shown and that four positioning elements 137P are provided in this figure, but it will be appreciated that a six positioning arms would be preferred for a six sided enclosure arms and that three positioning arms would be preferred for a triangular plan view enclosure. It will be realized that the carton could be of a rectangular cross-section, having unequal sides. It will also be appreciated that the system could be arranged for circular or oval plan boxes or even five or other multi-sided boxes—noting nonetheless, that the cold chain industry tends to utilize boxes and cartons of square section.

Figure 13D:
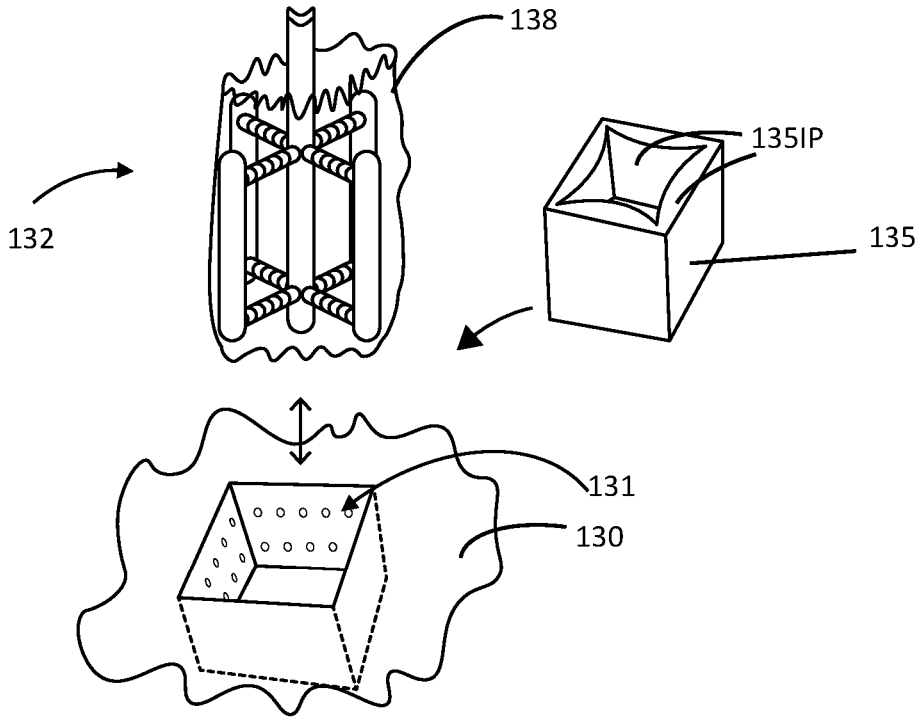

FIG. 13*d* is similar to FIG. 13*a*, save that the insert component is shown with a plastics bag 138 in position and, once carton 135 is inserted within the reception area 131, the vacuum pumps associated with the vacuum devices VD are operational whereby the insulation panels 135IP are seated within the carton 135 are then the insert component 132, can be lowered into the reception area, the actuation arms are then operated so that the plastics bag 138 is positioned about the inside surfaces of the insulation panels 135IP. As will be appreciated, if instead of a plastics bag, a tubular film could be provided, which may permit a single film to be utilised for a number of differing plan sections of carton. In use the film, after being properly placed about the inside faces of the insulation panels, then the tube can be cut and heat sealed about a central face of the closed end of the load receiving volume. The positioning elements, as discussed above may be provided with vacuum retention means to ensure that the bag or film PB is retained until the insert component is fully inserted, whereupon the vacuum to the positioning means is turned off and the vacuum within the reception area is initiated or increased. It has been found that electrostatic effects and or surface tension forces help the film of the bag to cling to the sides of the panels 135IP. However, by virtue of differences in material composition or otherwise, the attachment of the film—as exemplified by the so-called "cling-film" wrap as widely employed in the packaging industry and, particularly, within the domestic situation, where it is often used to cover food stuff prior to be placed within a refrigerator—may be retained without problem. However, in certain situations, this may not be the case, in which case retention can be assisted by the application of a film of oil from an aerosol can of light oil.

Figure 13E:
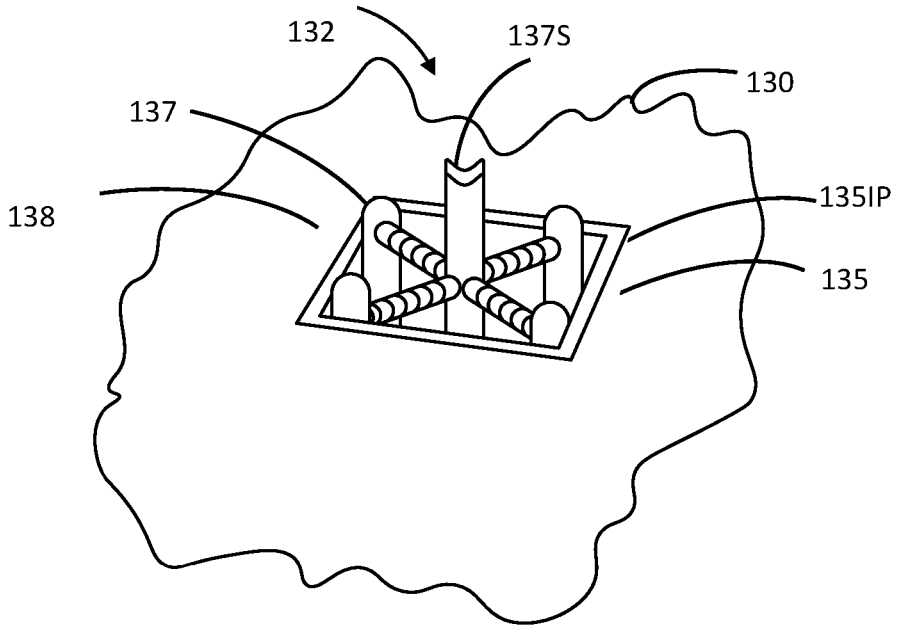

FIG. 13*e* shows an example of the situation wherein the insert component 132 is positioned within the reception area 130 and the external edges of the bag or film 138 of plastics is seen about the top ledge of the receiving area, with the actuation arms extended such that the positioning arms are at the inside corners of the load volume of the carton with panels in place. FIG. 13*f* shows how the plastics bag or film 138 is retained once the insertion device has been removed. The carton 135 can then be removed from the packaging machine, per FIG. 13*g* and be filled with goods, once temperatures have been reached relative to the particular packaging temperature of the products concerned, as will be realized by those skilled in the art. Importantly, the fact that there are gaps between the insulation panels 135IP will now be inconsequential to the future performance of the container in relation to the transfer of low temperature gasses from within the carton outwith the carton, assisting in the decrease of thermal transfer from within the carton/maintenance of the temperature therewithin.

The invention claimed is:

1. A low temperature transport/storage assembly comprising an outer carton, internal insulation, a load volume and a container for dry ice;

wherein the outer carton is provided with a base and sidewalls and a cover;

wherein the internal insulation comprises base and sidewall insulation panels, operably arranged to line the base and inside walls of the outer carton defining an inner carton, wherein the base and sidewall insulation panels are fastened together in an airtight fashion;

a first sleeve arranged to line an inside face of the base and sidewall insulation panels;

a second load receiving sleeve having sidewalls, the second load receiving sleeve spacing the second load receiving sleeve from the first sleeve, the second load receiving sleeve defining the load volume;

wherein the container for dry ice comprises a base and an oppositely presented aperture for placement of dry ice therein, the base of the container for dry ice being operably placed upon the second load receiving sleeve;

wherein the container for dry ice has a flat base whereby to abut against the second load receiving sleeve and any cover therefor.

2. The low temperature transport/storage assembly of claim 1, wherein the internal insulation comprises vacuum insulation panels.

3. The low temperature transport/storage assembly of claim 2, wherein the base and sidewall panels of the inner carton are arranged without spaces between adjacent vacuum insulation panels.

4. The low temperature transport/storage assembly of claim 1, wherein the cover to the outer carton comprises a separable lid with depending lips to enable securement with respect to the outer carton.

5. The low temperature transport/storage assembly of claim 1, wherein the outer carton is formed from one of corrugated cardboard or corrugated plastics or high density plastics foam.

6. The low temperature transport/storage assembly of claim 1, wherein, at the contact surface as between the lid and the upstanding walls of the inner carton, there is provided a seal, whereby to permit an increase of the internal pressure relative to ambient pressure.

7. The low temperature transport/storage assembly of claim 1, wherein the container for dry ice is capable of being flat packed when not in use.

8. The low temperature transport/storage assembly of claim 1, wherein the container for dry ice is fabricated from card, such as cardboard.

9. The low temperature transport/storage assembly of claim 1, wherein the container for dry ice is fabricated from sheet plastics materials.

10. The low temperature transport/storage assembly of claim 1, wherein the second load receiving sleeve, is formed from a planar rigid material, and is separated by upstanding elements to space the second load receiving sleeve from an inside face of the first sleeve and maintain a minimum spacing therefrom.

11. The low temperature transport/storage assembly according to claim 3, wherein the base and sidewall panels are sealed in an airtight fashion by a plastics film or bag about either the internal and/or external faces of the insulation panels.

12. The low temperature transport/storage assembly of claim 1, wherein the second load receiving sleeve includes one of cardboard spacing elements or plastics foam material to separate the second load receiving sleeve from an inside face of the first sleeve and maintain a minimum spacing therefrom.

13. The low temperature transport/storage assembly of claim 1, wherein the cover is provided with an insulation panel, whereby, upon closure of the cover, there is provided insulation between the inside of the outer carton and the outside lid.

14. The low temperature transport/storage assembly of claim 1, wherein there is provided a seal about the lid of the container that, in use, permits a release of excess pressure arising from sublimation or evaporation of products within the container.

15. The low temperature transport/storage assembly of claim 1; wherein the assembly is provided with a data logger unit and a thermocouple for measuring temperature; wherein the second load receiving sleeve is formed from a corrugated or apertured material, wherein the corrugated material or apertures are parallel to a wall surface of the second load receiving sleeve, whereby load temperatures can be monitored accurately, from a position close to the load volume, but not within the load volume.

16. The low temperature transport/storage assembly of claim 1, the second load receiving sleeve defining at least one channel that spaces the second load receiving sleeve from the first sleeve, the channel being configured to receive dry ice therein.

17. The low temperature transport/storage assembly of claim 1, further comprising a foam seal at the contact surface as between the lid and the upstanding walls of the inner carton.

18. A low temperature transport/storage assembly comprising an outer carton, internal insulation, a load volume and a container for dry ice;

wherein the outer carton is provided with a base and sidewalls and a cover;

wherein the internal insulation comprises base and sidewall insulation panels, operably arranged to line the base and inside walls of the outer carton defining an inner carton, wherein the base and sidewall insulation panels are fastened together in an airtight fashion;

a first sleeve arranged to line an inside face of the base and sidewall insulation panels;

a second load receiving sleeve having sidewalls, the second load receiving sleeve spacing the second load receiving sleeve from the first sleeve, the second load receiving sleeve defining the load volume;

wherein the container for dry ice comprises a base and an oppositely presented aperture for placement of dry ice therein, the base of the container for dry ice being operably placed upon the second load receiving sleeve;

wherein the container for dry ice has a flat base whereby to abut against the second load receiving sleeve and any cover therefor, wherein the container for dry ice includes first and second extended walls configured to pivot inwardly towards the flat base.

19. A low temperature transport/storage assembly comprising an outer carton, internal insulation, a load volume and a container for dry ice;

wherein the outer carton is provided with a base and sidewalls and a cover;

wherein the internal insulation comprises base and sidewall insulation panels, operably arranged to line the base and inside walls of the outer carton defining an inner carton, wherein the base and sidewall insulation panels are fastened together in an airtight fashion;

a first sleeve arranged to line an inside face of the base and sidewall insulation panels;

a second load receiving sleeve having sidewalls, the second load receiving sleeve spacing the second load receiving sleeve from the first sleeve, the second load receiving sleeve defining the load volume;

wherein the container for dry ice comprises a base and an oppositely presented aperture for placement of dry ice therein, the base of the container for dry ice being operably placed upon the second load receiving sleeve;

wherein the container for dry ice has a flat base whereby to abut against the second load receiving sleeve and any cover therefor, wherein the first sleeve laterally surrounds the second load receiving sleeve.

20. The low temperature transport/storage assembly of claim 19, wherein the flat base of the container for dry ice includes an outer bottom surface in direct contact with an upper surface of the second load receiving sleeve.

* * * * *